United States Patent [19]

Masterfield

[11] Patent Number: 4,570,608

[45] Date of Patent: Feb. 18, 1986

[54] ARCHERY BOW STABILIZER AND VIBRATION DAMPENER

[76] Inventor: Ernest W. Masterfield, 7420 Wade Cir., Anchorage, Ak. 99502

[21] Appl. No.: 480,006

[22] Filed: Mar. 29, 1983

[51] Int. Cl.[4] ..... F41B 5/00

[52] U.S. Cl. ..... 124/89; 188/378

[58] Field of Search ..... 124/89, 23 R, 24 R, 124/88; 188/378, 266, 297

[56] References Cited

U.S. PATENT DOCUMENTS

| | | | |
|---|---|---|---|
| 3,342,172 | 9/1967 | Sanders | 124/89 X |
| 3,412,725 | 11/1968 | Hoyt | 124/24 R |
| 3,524,441 | 8/1970 | Jeffery | 124/24 R |
| 3,670,712 | 6/1972 | Izuta | 124/24 R X |
| 4,342,429 | 8/1982 | Katoh et al. | 188/266 X |

*Primary Examiner*—Richard J. Apley
*Assistant Examiner*—William R. Browne
*Attorney, Agent, or Firm*—Neil J. Driscoll

[57] ABSTRACT

An inertial archery bow stabilizer and vibration dampner is disclosed. A stud is rigidly embedded in the archery bow and has an energy disipating rod fixed to and projecting forwardly of the stud. The rod is received within an encapsulating sealed cylinder having an internal chamber filled with a viscous fluid in which the rod is disposed. At its outer end and externally thereof, the cylinder is provided with another stud to which the archer may afix a selected stabilizing weight. The stabilizer is effective to limit bow movement during arrow cast and rapidly dampen and attenuate energy released as characterized by dampened bow vibration.

6 Claims, 3 Drawing Figures

ARCHERY BOW STABILIZER AND VIBRATION DAMPENER

BACKGROUND OF THE INVENTION

1. Field of the Invention

The invention relates to an archery bow stabilizer and vibration dampener particularly adapted to inhibit bow torque during arrow release, thus accomodating a more accurate arrow flight path, and to also dampen and attenuate vibrational energy released in the bow per se by the violent return of the bow limbs to the at rest postion after arrow launch.

Recent years have seen an increased public interest in field and target archery. Concurrently with this growth, investigation into the physical aspects of arrow launch has been undertaken to effect techniques to improve the archer's accuracy. These investigations have shown that some archers torque the bow off target line by involuntary muscular reaction during arrow cast. Torque and resulting bow movement is also produced by a physical reactive effect known as the "archer's paradox". Briefly, just prior to arrow release, the forward portion of the arrow is physically resting against the bow at the arrow plate and the arrow nock at the rear is engaging the bow string with the archer's fingers embracing the arrow and holding the drawn string. At release, the bow string rolls slightly to the left off of the archer's fingers and the arrow nock moves to the left with the string. The thrust of the bow draw-weight is transferred to the arrow which causes the arrow to bend and induce a torque applied against the arrow plate on the bow. This action moves the bow slightly and the arrow reverses its bend and passes from the bow at the arrow plate without touching said plate. On true center shot bows, of recent design, the torque action is somewhat reduced.

In addition to bow torquing archer's are familiar with the fact that vibration and "bow kick" upon arrow release are frequently the cause of many inaccurate shots. Vibration and bow kick are also physically discomforting to the archer engaged in frequent contests requiring many shots over a short period of time. 2. Discription of the Prior Art To aid in controlling bow torque, devices called stabilizers have been developed by archery technicians. Initially, the stabilizers consisted of adding weight internally to the grip section of the bow. The added weight increased bow stability by increasing the inertial capacity of the bow. Thereafter, the idea developed to provide an arm and extend the added weight forwardly of the bow to provide a "lever arm" and further increase the inertial movement resistive capactiy of the bow. Prior stabilizers have been provided that are adjustable in length and weight. There have been both stiff and soft couplers where the stabilizer rod is attached to the bow. Soft couplers consists of the interposition of resilient rubber-like material in the connection line. The purpose of the resilient material is to prevent rigid contact path between the rod and weighted head of the stabilizer and the bow per se. Examples of these prior art structures are U.S. Pat. No. 3,524,441, dated Aug. 18, 1970 and U.S. Pat. No. 4,135,486, dated Jan. 23, 1979. In addition, U.S. Pat. No. 3,412,725, dated Nov. 26, 1968 discloses a bow having hollow cylinders embeded in the body of the bow above and below the grip section and extending transversly of the bow body. Spring loaded pistons are disposed in the cylinders to provide inertial resistance to torque and a viscous liquid is placed in the cylinders to dampen sustained oscillations and prevent the noise of metal to metal contact of the weighted piston with the cylinder.

SUMMARY OF THE INVENTION

Accordingly, it is a primary object of the invention to provide an inertial stabilizer extending forwardly of the front section of the bow and connected to the bow in a demountable but rigid manner, so that a rigid contact path is provided between the bow and the weighted head, positioned at the forward terminus of the stabilizer.

It is a further object of the invention to provide an inertial stabilizer of the type described adapted to accomodate heads of different weights so that the archer may select the weight that is most suitable for his particular bow.

It is yet another object of the invention to provide a inertial stabilizer having a hollow cylinder extending forwardly of the front section of the bow, said cylinder being adapted to receive a viscous liquid, such as oil, said liquid attenuating vibration induced by energy distributed throughout the bow during arrow cast.

It is still another object of the invention to provide a hollow cylinder inertial stabilizer as described which includes an energy distributing rod positioned within the viscous liquid within the hollow cylinder and having a rigid contact path connection with both the bow and the hollow cylinder.

The major features of the invention add substantially to the accuracy with which an archer can cast his arrow and also decreases any discomfort to which the archer may be subject to during archery exercises.

These and other objects, features and advantages of the invention will become apparent in the course of the following description of a presently preferred embodiment of the invention.

DESCRIPTION OF THE PREFERRED EMBODIMENT

Figure 1:
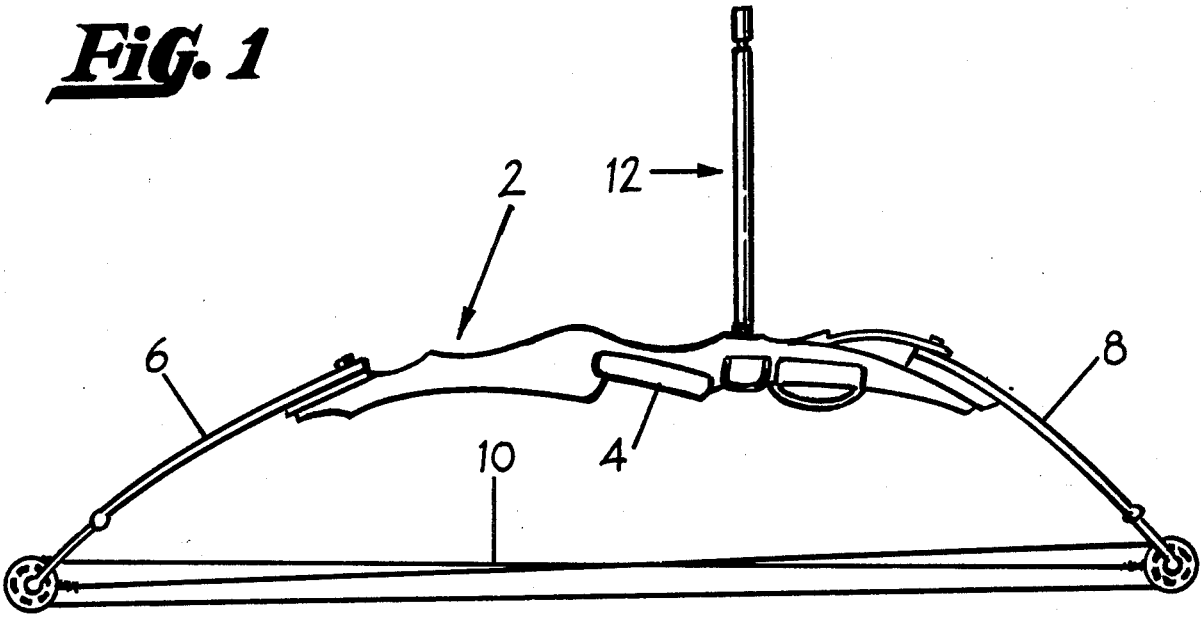
FIG. 1 is a side elevational view of an archery bow having the herein disclosed stabilizer secured to and projecting forwardly of the front section of the bow.

Directing attention to FIG. 1, the numeral 2 generally designates a current state of the art archer's bow. The bow includes a handle riser section 4, upper limb 6 and a lower limb 8. String 10 connects the upper and lower limbs 6 and 8 in the conventional manner. The subject of the present invention is a stabilizer, indicated generally at 12, which is secured to the bow just below the handle and in the riser section projects forwardly therefrom.

Figure 2:
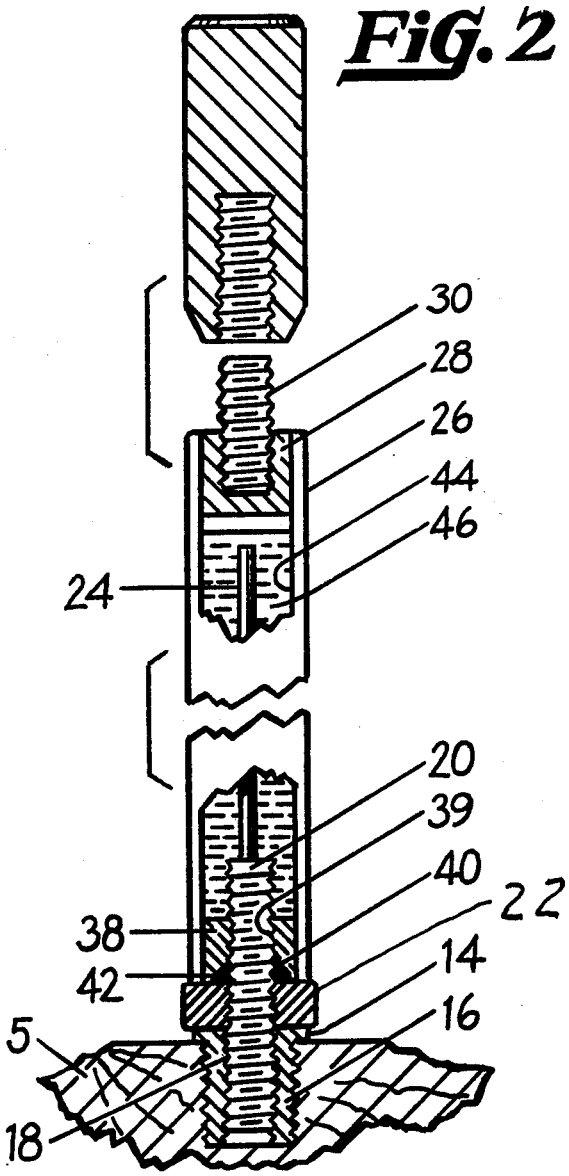
FIG. 2 is a partially fragmented vertical section view of the herein disclosed stabilizer with the various components thereof in an assembled condition and mounted to the bow.
Figure 3:
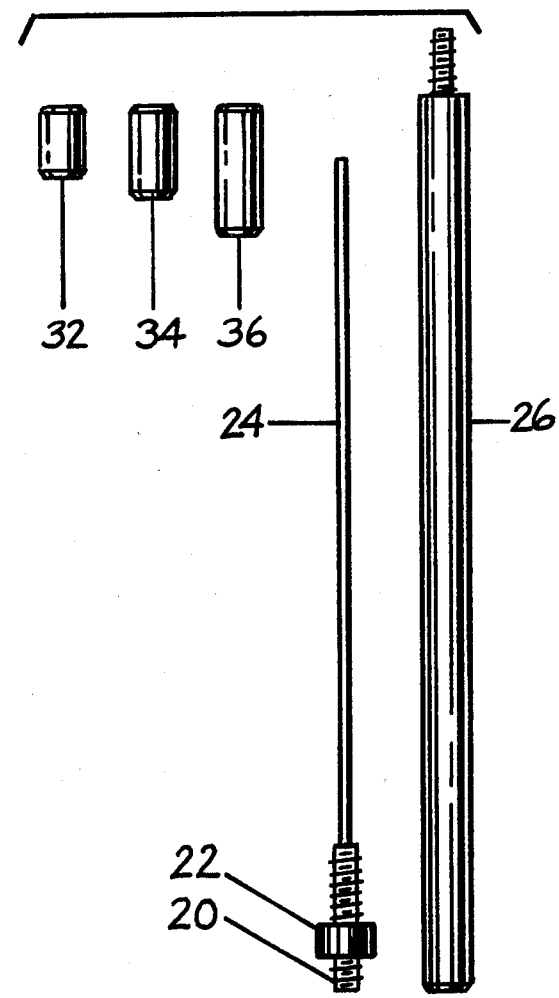
FIG. 3 is a composite plan view of the stabilizer in disassembled condition.

The structural details of the stabilizer 12 are shown in FIGS. 2 and 3, respectively. In FIG. 2 the bow is shown in fragmented section at 5 and is there provided with a metallic insert 14 which may be threadably mounted in the bow as at 16 to provide a rigid connection therewith. The insert 14 is centrally threadably apertured as at 18 to receive the threaded stud 20. The stud 20 has a nut element 22 secured thereto whereby the stud 20 may be rotated until it is securely mounted in the insert 16 and rigidly secured to the bow 2. At its forward aspect the stud 20 has an energy distributing rod 24 rigidly secured thereto as by press fit, welding or brazing.

The stabilizer 12 additionally comprises a hollow cylinder 26 which has its outer end permanently closed by the plug 28. The plug 28 fixedly receives a weight stud 30, the latter adapted to threadably and demountably receive an archer selected stabilizing weight 32, 34 or 36. Weights 32,34 and 36 are of varying sizes one of which may be selected by the archer as best adapted to his bow.

The inner end of the cylinder 26 (with respect to the bow) has affixed thereto a plug 38 which is centerally threaded as at 39 to threadably receive the stud 20. The plug 38 may be chamfered as at 40 to receive rubber sealing ring 42 as the nut 22 is brought into contact with the adjacent end of cylinder 26. Thus the cylinder 26 is sealed. Prior to assembly with the bow 2, the internal chamber 44 of the cylinder 26 is filled with a viscous fluid as at 46.

With the structure described there is a rigid metallic contact path between the bow at 5 and through the insert 16, stud 20, nut 22, plug 38, cylinder 26 and rod 24.

During arrow cast the rigid stabilizer 12 and the selected weight 32, 34 or 36 provides inertial resistance to bow vibrations effectively controlling same and minimizing its effect on arrow cast. Further, the energy distributed throughout the bow as the limbs return to their rest positions is distributed to the fluid 46 and its vibrations effectively attenuated and dampened. Because all of the components of the stabilizer are in direct rigid contact with each other, energy will be distributed to the fluid 46 through the stud 20, the rod 24, the plugs 28 and 38, and the cylinder 26.

As a typical example, substantially improved bow stability has been demonstrated on 55 to 60 pound bow using a stabilizer comprising a thin walled metallic tube 26 about 18 inches long. The stud 20 is a 5/16 standard thread about 1 and $\frac{3}{4}$ inches long. The rod 24 secured thereto is about $\frac{1}{8}$ inch in diameter and 14 inches long. The viscous fluid used was automotive hydralic brake fluid, ie a light viscosity. Any conventional means such as a set screw (not shown) or locking drive pin (not shown) may be used to fix the nut 22 to stud 20 and cylinder 26 so that the seal ring 42 is tight and fluid leakage will be prevented during mounting or removal of the stabilizer from the bow.

The invention as disclosed is by the way of illustration and not limitation and may be subject to modification all within the spirit and scope thereof.

What is claimed is:

1. In an inertial stabilizer for a conventional archery bow, said stabilizer comprising:

a hollow member, a viscous fluid disposed in said member, energy dissipating means including a stud for rigid connection to a conventional bow, said hollow member being fixedly and rigidly connected to the stud, a rod connected to the stud and disposed within the hollow member in direct contact with the viscous fluid, said stabilizer being arranged to extend outwardly and generally forwardly of said conventional bow when mounted thereon.

2. An inertial stabilizer for a conventional archery bow according to claim 1, and including connection means at the outer end of the member adapted to fixedly and selectively connect a stabilizer weight thereto.

3. An apparatus for rigid, removable attachment to a forward portion of a handle on a conventional archery bow to dampen vibrations during arrowcasting comprising:

an axially elongated hollow member having a viscous fluid disposed within a chamber in the member, means to fixedly secure the apparatus to a bow so that the axially elongated member extends generally forwardly of a bow, and means communicating with the viscous fluid to distribute bow-created vibrations to the fluid during arrowcast and to thereby dampen the vibratory effects of the deflexing energy of an arrowcast on a bow, said communicating means comprising an energy distributing rod means having one end thereof formed for rigid embedment in a forward bow handle portion and with the other end of said rod means projecting forwardly into the chamber and into direct contact with the viscous fluid.

4. In a stabilizer for a conventional archery bow having a central handle portion comprising;

a hollow generally cylindrical member having a chamber therein, a viscous fluid disposed within said chamber, securing means at one end of the generally cylindrical member to fixedly mount the stabilizer to a handle portion of an archery bow so that, when so mounted, the stabilizer will project generally forward of a bow handle portion, said securing means including energy distributing means disposed within the chamber and in direct contact with the viscous fluid.

5. A stabilizer according to claim 4, wherein said securing means includes:

one end of a stud formed for embedment in the handle portion when the stabilizer is mounted on a bow, the other end of said stud being rigidly connected to the generally cylindrical member, said energy distributing means including a rod connected to the stud and disposed within the chamber.

6. A stabilizer according to claim 5, and including:

means removably connecting an inertial stabilizing weight to the cylindrical member at the point thereon most distal from a bow handle portion when the stabilizer is mounted on a bow handle portion.

* * * * *